US011328856B2

(12) United States Patent
Ishimori et al.

(10) Patent No.: US 11,328,856 B2
(45) Date of Patent: May 10, 2022

(54) AIR CORE REACTOR FOR ROLLING STOCK

(71) Applicant: Mitsubishi Electric Corporation, Tokyo (JP)

(72) Inventors: Yuki Ishimori, Tokyo (JP); Tetsuya Sakurada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 540 days.

(21) Appl. No.: 16/463,967

(22) PCT Filed: Dec. 19, 2016

(86) PCT No.: PCT/JP2016/087849

§ 371 (c)(1),
(2) Date: May 24, 2019

(87) PCT Pub. No.: WO2018/116362

PCT Pub. Date: Jun. 28, 2018

(65) Prior Publication Data

US 2020/0381172 A1 Dec. 3, 2020

(51) Int. Cl.
*H01F 27/02* (2006.01)
*H01F 27/30* (2006.01)
(Continued)

(52) U.S. Cl.
CPC ..... *H01F 27/306* (2013.01); *H01F 27/324* (2013.01); *H01F 41/04* (2013.01)

(58) Field of Classification Search
USPC ..... 336/59
See application file for complete search history.

(56) References Cited

U.S. PATENT DOCUMENTS 1,396,563 A * 11/1921 Faccioli ..... H01F 27/2871 336/185
2,901,717 A * 8/1959 Storsand ..... H01F 37/005 336/174
(Continued)

FOREIGN PATENT DOCUMENTS

JP H0323913 U 3/1991
JP H08186036 A 7/1996
(Continued)

OTHER PUBLICATIONS

International Search Report (PCT/ISA/210) dated Feb. 14, 2017, by the Japan Patent Office as the International Searching Authority for International Application No. PCT/JP2016/087849.
(Continued)

*Primary Examiner* — Ronald Hinson
(74) *Attorney, Agent, or Firm* — Buchanan Ingersoll & Rooney PC

(57) ABSTRACT

A reactor is equipped with a coil having unit coils. First spacers are disposed in at least one of spaces between the unit coils and in a space between one of the unit coils and a supporting frame. Second spacers are disposed between the first spacers. The supporting frames, the first spacers, and the second spacers are traversed by bolts and are fixed to the bolts. A space is defined between the bolt and a wall surface of a through hole formed in the first spacer and traversed by the bolt. A spacing distance between adjacent first spacers in the central axis direction of the coil is greater than a central-axis-direction thickness of the unit coil located between the adjacent first spacers, the central-axis-direction thickness of the unit coil being of when the coil is not energized.

20 Claims, 6 Drawing Sheets

(51) Int. Cl.
*H01F 27/32* (2006.01)
*H01F 41/04* (2006.01)

(56) References Cited

U.S. PATENT DOCUMENTS

| | | | | |
|---|---|---|---|---|
| 4,177,441 | A * | 12/1979 | Lichtenberger | H01F 7/08 335/276 |
| 8,009,005 | B2 * | 8/2011 | Hara | H01F 27/02 336/68 |
| 10,821,835 | B2 * | 11/2020 | Inaba | H01F 37/00 |
| 2004/0113733 | A1 * | 6/2004 | Miettinen | H01F 27/027 336/5 |
| 2010/0301986 | A1 | 12/2010 | Hara et al. | |

FOREIGN PATENT DOCUMENTS

| | | | |
|---|---|---|---|
| JP | H10256057 | A | 9/1998 |
| JP | 2000150250 | A | 5/2000 |
| JP | 4738531 | B2 | 8/2011 |

OTHER PUBLICATIONS

Written Opinion (PCT/ISA/237) dated Feb. 14, 2017, by the Japan Patent Office as the International Searching Authority for International Application No. PCT/JP2016/087849.

* cited by examiner

AIR CORE REACTOR FOR ROLLING STOCK

TECHNICAL FIELD

The present disclosure relates to an air core reactor for rolling stock.

BACKGROUND ART

Rolling stock is equipped with a reactor for suppression of sudden changes in current flowing in a main circuit. When the reactor is arranged beneath a floor of the rolling stock, a horizontal type reactor for which a central axis of a coil is horizontal is used in order to prevent leakage of magnetic flux toward a train car from the reactor. The horizontal type reactor mounted on the rolling stock is an air core reactor, the coil of which is sufficiently cooled during natural cooling. The air core reactor has a coil wound around the horizontal central axis, and supporting frames to which the coil is attached. The air core reactor is fixed to a vehicle body by attachment of the supporting frames to the vehicle body.

In order to prevent damage due to vibration during travel of the train, the coil and the supporting frames of the air core reactor for rolling stock are integrally fixed together. In a reactor device for rolling stock described in Patent Literature 1, supporting frames are attached to both horizontal central axis ends of the coil, and bolts traverse the supporting frames and the coil to fix together the supporting frames and the coil.

CITATION LIST

Patent Literature

Patent Literature 1: Japanese Patent No. 4738531

SUMMARY OF INVENTION

Technical Problem

In a reactor device for rolling stock described in Patent Literature 1, compressive force is applied to the coil due to fastening of the bolts traversing the coil and the supporting frames. When temperature of the coil rises due to current flowing in the main circuit, the coil thermally expands between the supporting frames, and the compressive force applied to the coil increases. Such increasing compressive force applied to the coil may decrease insulation performance and insulation lifetime of the reactor.

In consideration of the aforementioned circumstances, an objective of the present disclosure is to lower the compressive force applied to the coil.

Solution to Problem

In order to attain the aforementioned objective, an air core reactor for rolling stock of the present disclosure includes a coil, a pair of supporting frames, insulating first spacers, second spacers, bolts, and fastening members. The coil has unit coils wound around a central axis that is horizontal, and the unit coils are adjacent to each other with spaces therebetween in a central axis direction that is a direction of the central axis. The pair of supporting frames sandwiches the coil therebetween and has main faces opposing each other in the central axis direction. The first spacers are disposed in (i) at least one of the spaces between the unit coils adjacent to each other in the central axis direction and (ii) a space between each of the supporting frames and the coil. The first spacers have projection parts that project outwardly from an outer peripheral face of the coil around the central axis. The second spacers are each disposed between the projection parts of the first spacers adjacent to each other in the central axis direction. The bolts each traverse the pair of supporting frames, the first spacers, and the second spacers. The fastening members are fastened at both ends of each of the bolts to sandwich the pair of supporting frames so that the pair of supporting frames, the first spacers, and the second spacers are fixed relative to the bolts. A spacing distance between the adjacent first spacers is greater than a central-axis-direction thickness of the unit coil located between the adjacent first spacers, the central-axis-direction thickness of the unit coil being of when the coil is not energized.

Advantageous Effects of Invention

According to the present disclosure, the first spacers are disposed between the adjacent unit coils, the second spacers are disposed between the adjacent first spacers; the supporting frames, the first spacers, and the second spacers are fixed to the bolts traversing the supporting frame, the first spacers, and the second spacers; and the spacing distance between the adjacent first spacers is set to be greater than the central-axis-direction thickness of the unit coil located between the adjacent first spacers, the central-axis-direction of the unit coil being of when the coil is not energized, and thus the compressive force applied to the coil can be decreased.

DESCRIPTION OF EMBODIMENTS

Figure 1:
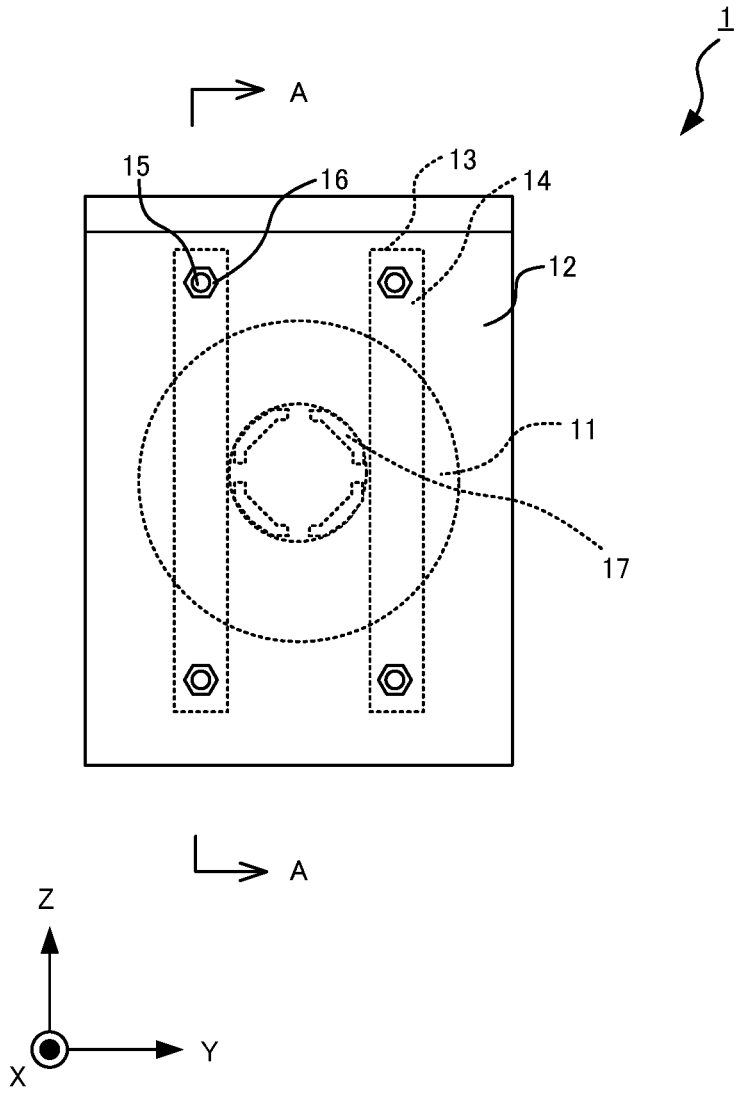
FIG. 1 is a side view of a reactor according to Embodiment 1 of the present disclosure.

Embodiments of the present disclosure are described below in detail with reference to the drawings. In the drawings, components that are the same or equivalent are assigned the same reference sign.

Embodiment 1

Figure 2:
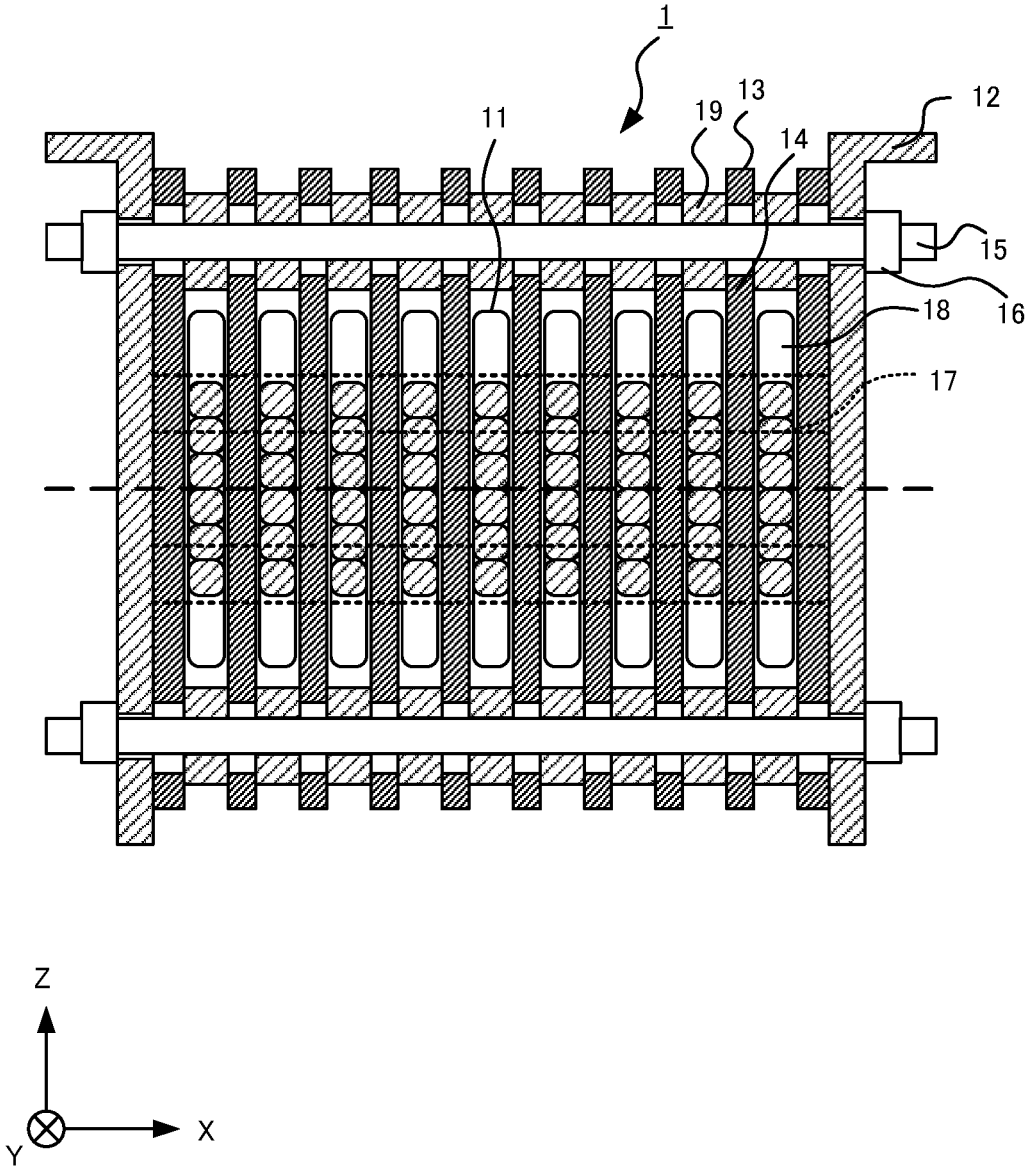
FIG. 2 is a cross-sectional view of the reactor according to Embodiment 1.

FIG. 1 is a side view of a reactor according to Embodiment 1 of the present disclosure. FIG. 2 is a cross-sectional view of the reactor according to Embodiment 1. FIG. 2 is a cross-sectional view taken along line A-A in FIG. 1. A reactor 1 is an air core type reactor and is mounted on rolling stock. The reactor 1, for example, is attached below a floor of a train car. When the train car is located at a horizontal location, a central axis of a coil 11 with which the reactor 1 is equipped is positioned horizontally. The central axis of the coil 11 is indicated in FIG. 2 by a dashed line. In FIGS. 1 and 2, the Z axis is the vertical direction, the X axis is the horizontal direction, and the Y axis is a direction orthogonal to both the X axis and the Z axis.

The coil 11 has unit coils 18 that are wound around the central axis and are adjacent to each other with spaces therebetween in the X-axis direction. The reactor 1 is equipped with a pair of supporting frames 12 sandwiching the coil 11 therebetween and having main faces opposing each other in the central axis direction of the coil 11, and first spacers 13 that are insulative and disposed in (i) at least one of the spaces between the unit coils 18 and (ii) a space between each of the supporting frame 12 and the coil 11. The first spacer 13 is formed, for example, from a fiber-reinforced plastic (FRP), resin, or the like. The first spacer 13 has a projection part 14 that projects outwardly from an outer peripheral face of the coil 11 around the central axis. By arrangement of the first spacer 13 between the unit coils 18, a ventilation path is secured between the unit coils 18, and cooling performance of the reactor 1 can be improved. The reactor 1 may also be equipped with a cover that covers the coil 11 around the central axis thereof.

The reactor 1 is further equipped with second spacers 19 that are each disposed between the projection parts 14 of the first spacers 13 adjacent to each other in the X-axis direction. The pair of supporting frames 12, the first spacers 13, and the second spacers 19 are traversed by bolts 15. Fastening members 16 are fastened at both ends of each of the bolts 15 to sandwich the pair of supporting frames 12, and the pair of supporting frames 12, the first spacers 13, and the second spacers 19 are thereby fixed relative to the bolts 15. Each of the bolts 15 and the fastening members 16 are, for example, formed from a metal that has at least a determined value of hardness, such as iron, stainless steel, or the like. The determined value is determined in accordance with a design of the reactor 1. Each of the bolts 15 is arranged at a position that ensures an insulating distance to the coil 11. The reactor 1 is further equipped with an insulating supporting member 17 that abuts an outer peripheral face or an inner peripheral face around the central axis of the coil 11 to suppress movement of the coil 11 in the X-axis direction, and supports the coil 11 in the Z-axis direction.

A space is defined between an outer peripheral face of each of the bolts 15 and a wall surface of a through hole formed in each of the first spacers 13 and traversed by each of the bolts 15. A spacing distance between the first spacers 13 adjacent to each other in the X-axis direction is greater than a thickness of the unit coil 18 located between the first spacers 13 adjacent to each other in the X-axis direction, the thickness of the unit coil 18 being of when the coil 11 is not energized. Since the spacing distance between the first spacers 13 adjacent to each other in the X-axis direction is greater than the thickness of the unit coil 18 that is of when the coil 11 is not energized, compressive force due to fastening of the bolts 15 is not applied to the coil 11. The X-axis direction thickness of the first spacer 13 adjacent to the supporting frame 12 is determined in accordance with the insulating distance between the supporting frame 12 and the coil 11.

In the example of FIGS. 1 and 2, the unit coil 18 is a disc type coil wound around the central axis, and the reactor 1 is equipped with unit coils 18 arranged in the X-axis direction. The coil 11 is formed from aluminum or copper. The coil 11 may be a coil conductor spirally wound around the central axis. In this case, the unit coil 18 corresponds to a single turn portion of the coil conductor spirally wound around the central axis.

In Embodiment 1, the reactor 1 is equipped with a plurality of pairs of first spacers 13 extending in the vertical direction, each pair of first spacers 13 opposing each other in the horizontal direction on opposite sides of the central axis. Projection parts 14 are formed at both Z-axis direction ends of each first spacer 13. In the example of FIGS. 1 and 2, although the first spacer 13 is a rectangular parallelepiped, the shape of the first spacer 13 may be freely selected. Furthermore, the reactor 1 may be equipped with a freely selected number of first spacers 13. The direction of the first spacer 13 may be any direction as long as the projection parts 14 included in the first spacer 13 are positioned outwardly from the outer peripheral face of the coil 11. Although the first spacers 13 are arranged between all of the mutually adjacent unit coils 18 in the example of FIG. 2, the spacing of the first spacers being arranged may be freely selected. For example, the first spacers 13 may be arranged in every other space between the adjacent unit coils 18.

In Embodiment 1, the second spacer 19 is ring shaped in a cross-section perpendicular to the X-axis direction. The second spacer 19 has an outer diameter larger than a diameter of the through hole that is traversed by the bolt 15 and formed in the first spacer 13. The second spacer 19 has an inner diameter larger than the diameter of the bolt 15. In the same manner as the first spacer 13, the shape of the second spacer 19 may be freely selected. The second spacer 19 may be formed from the same material as that of the bolt 15 and the fastening member 16. For example, the second spacer 19 may be formed from a metal such as iron, stainless steel, or the like.

In Embodiment 1, each second spacer 19 abuts the adjacent first spacers 13 that sandwich each second spacer 19. An X-axis direction thickness of the second spacer 19 may be set to a value greater than an X-axis direction thickness of the unit coil 18 located between the adjacent first spacers 13 sandwiching the second spacer 19, the X-axis direction thickness of the unit coil 18 being of when the coil 11 is energized. Due to such configuration, even when the coil 11 is energized, a space exists between the coil 11 and the first spacer 13, and the application of excessive compressive force to the coil 11 can be suppressed even when the coil 11 is energized.

In the example of FIGS. 1 and 2, the supporting member 17 is fixed at both ends thereof to the pair of supporting frames 12. The supporting member 17 abuts the inner peripheral face of the coil 11 and is fixed to the coil 11. Thus, the supporting member 17 suppresses X-axis direction movement of the coil 11 and supports the coil 11 in the Z-axis direction. Although the reactor 1 is equipped with four supporting members 17 in the example of FIGS. 1 and 2, the shape of the supporting members 17 is not limited to the shape of the example illustrated in FIGS. 1 and 2. For example, the reactor 1 may be equipped with a cylindrical supporting member 17 having an outer peripheral face that abuts the inner peripheral face of the coil 11. A ventilation opening may be arranged in the supporting member 17, thereby enabling improvement of cooling performance of the reactor 1. The method of fixing together the supporting member 17 and the coil 11 may be freely selected, and for example, a groove arranged in the outer peripheral face of the supporting member 17 may engage the inner peripheral face of the coil 11.

The X-axis direction thickness of the first spacer 13 arranged between the unit coils 18 may be constant as illustrated in FIG. 2, or may be determined in accordance with distances from the pair of supporting frames 12. For example, the first spacers 13 located at positions where differences in distances of the first spacers 13 from the pair of supporting frames 12 are smaller, that is, the first spacers 13 located nearer the X-axis direction center of the coil 11, may have greater X-axis direction thicknesses. Thus, when the coil 11 is energized, cooling efficiency can be increased at an X-axis direction central part of the coil 11 for which the temperature rise is larger than for the X-axis direction ends of the coil 11.

The reactor 1 is assembled as described below. One end of the supporting member 17 is fixed to one of the supporting frames 12. The bolts 15 are passed though the through holes of the one supporting frame 12. The bolts 15 are passed through the through holes of the first spacer 13, and the first spacer 13 is positioned. The bolts 15 are passed through the through holes of the second spacer 19, and the second spacer 19 is positioned. Then the unit coil 18 is arranged adjacent to the first spacer 13. Thereafter, the arranging of the first spacer 13, the second spacer 19, and the unit coil 18 is repeated. Then after arrangement of the last unit coil 18, the bolts 15 are passed through the through holes of the first spacer 13, and the first spacer is positioned. Then the other supporting frame 12 is arranged at a position adjacent to this first spacer 13, and the supporting member 17 and the supporting frame 12 are fixed together. The assembly of the reactor 1 is completed by fastening of the fastening members 16 to the bolts 15.

Figure 3:
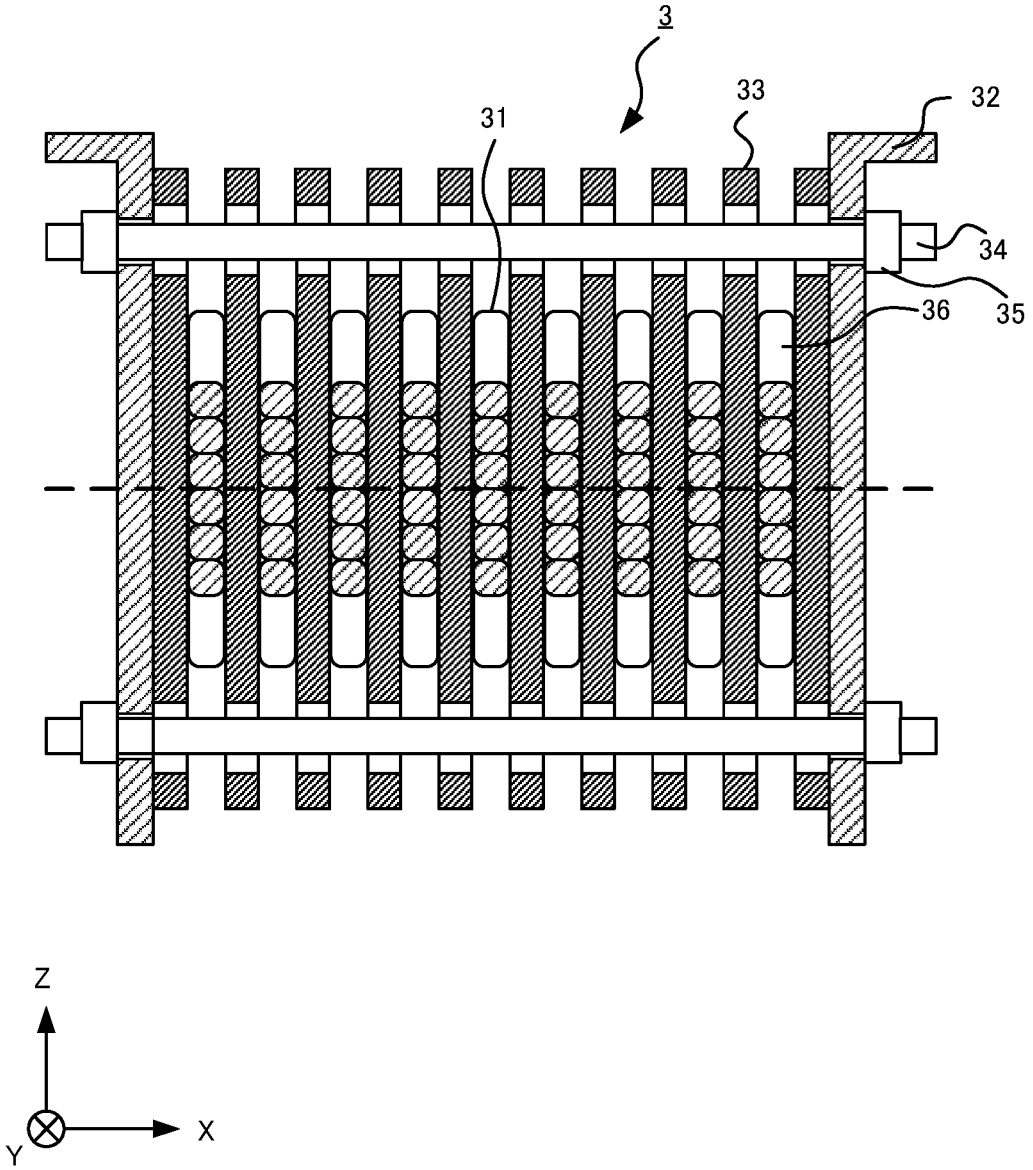
FIG. 3 is a cross-sectional view of a reactor in which pressing force is applied to the coil.

FIG. 3 is a cross-sectional view of the reactor in which pressing force is applied to the coil. A reactor 3 illustrated in FIG. 3 is equipped with: a coil 31 having unit coils 36 that are wound around the central axis and are adjacent to each other with spaces therebetween in the X-axis direction, a pair of supporting frames 32 sandwiching the coil 31 and having main faces opposing each other in the X-axis direction, and insulating first spacers 33 disposed between the units coils 36 and between each of the supporting frames 32 and the coil 31. Each first spacer 33 abuts the adjacent unit coils 36 that sandwich each first spacer 33. The pair of supporting frames 32 and the first spacers 33 are traversed by bolts 34. Fastening members 35 are fastened to both ends of each of the bolts 34, and the pair of supporting frames 32 and the first spacers 33 are thereby fixed relative to the bolts 34. The compressive force due to fastening of the bolts 34 is applied to the coil 31, the supporting frames 32, and the first spacers 33.

Figure 4:
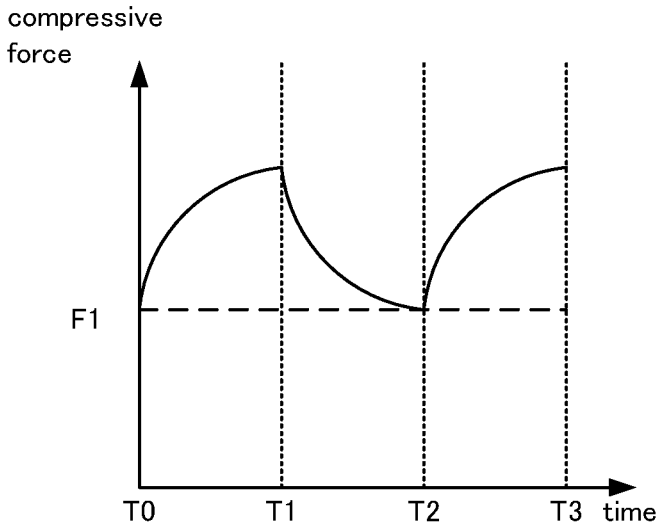
FIG. 4 is a graph illustrating an example of compressive force applied to the coil.

FIG. 4 is a graph illustrating an example of the compressive force applied to the coil. In FIG. 4, the horizontal axis indicates time, and the vertical axis indicates the compressive force. FIG. 4 illustrates the compressive force applied to the coil 31 illustrated in FIG. 3. The coil 31 is energized between times T0 and T1, and between times T2 and T3. The coil 31 is not energized between the times T1 and T2. Although the coil 31 is not energized at the times T0 and T2, in the aforementioned manner, a compressive force F1 is applied to the coil 31 by fastening of the bolts 34. Energization of the coil 31 between the times T0 and T1 and between the times T2 and T3 causes the coil 31 to expand, and thus thermal stress occurs in the coil 31. That is to say, an excessive stress may occur in the coil 31 during energization of the coil 31.

Figure 5:
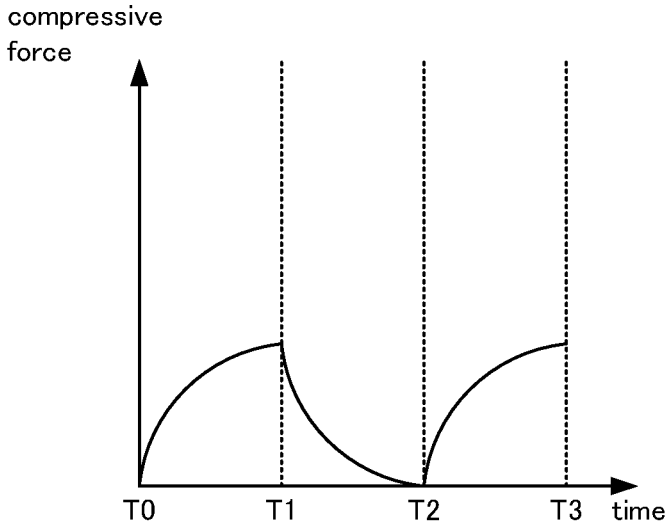
FIG. 5 is a graph illustrating an example of compressive force applied to the coil of the reactor according to Embodiment 1.

FIG. 5 is a graph illustrating an example of the compressive force applied to the coil of the reactor according to Embodiment 1. The graph is annotated in the same manner as FIG. 4. In the reactor 1 according to Embodiment 1, the compressive force is not applied to the coil 11 at the times T0 and T2. Thus excessive stress does not occur in the coil 11 even when the coil 11 is energized.

Figure 6:
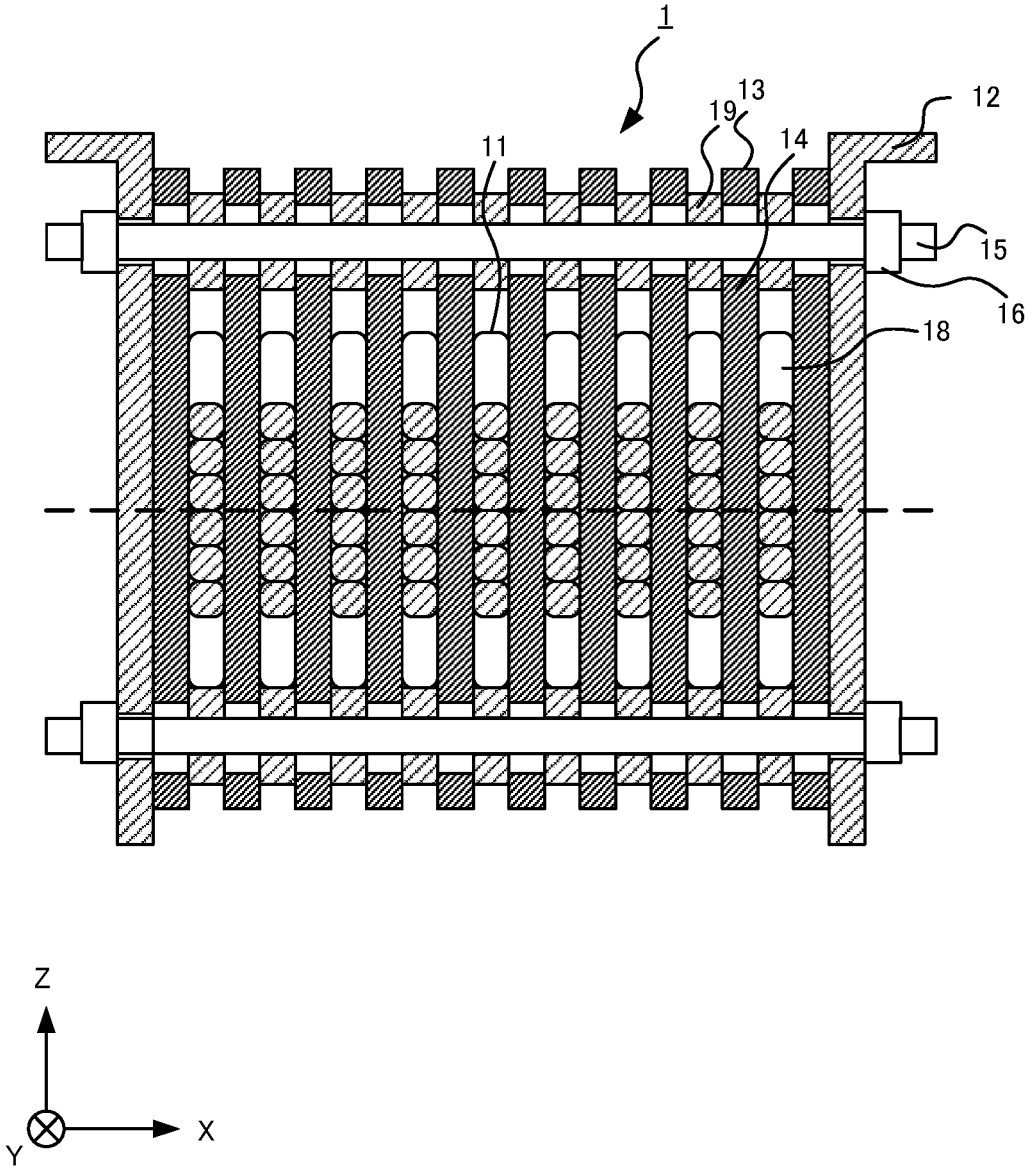
FIG. 6 is a cross-sectional view of the reactor according to Embodiment 1.

FIG. 6 is a cross-sectional view of the reactor according to Embodiment 1. The reactor 1 illustrated in FIG. 6 is not equipped with the supporting member 17. In the reactor 1 illustrated in FIG. 6, the second spacers 19 are disposed between the projection parts 14 that are formed by the vertically lower-side ends of the first spacers 13, and are formed as insulating members. The second spacers 19 disposed between the projection parts 14 located on the vertically lower side abut the outer peripheral face of the coil 11 and are fixed to the coil 11, thereby supporting the coil 11 in the vertical direction. That is to say, the second spacers 19 arranged between the projection parts 14 located on the vertically lower side correspond to the supporting member 17.

As described above, in the reactor 1 according to Embodiment 1, the first spacers 13 are disposed between the adjacent unit coils 18; the second spacers 19 having a thickness greater than the thickness of the unit coil 18 that is of when the coil 11 is not energized are disposed between the first spacers 13; the supporting frames 12, the first spacers 13, and the second spacers 19 are fixed to the bolts 15 traversing the supporting frames 12, the first spacers 13, and the second spacers 19; and the supporting members 17 are disposed abutting the outer peripheral face or the inner peripheral face of the coil 11 so as to support the coil 11 in the vertical direction; and thus the compressive force applied to the coil can be decreased.

Embodiment 2

Figure 7:
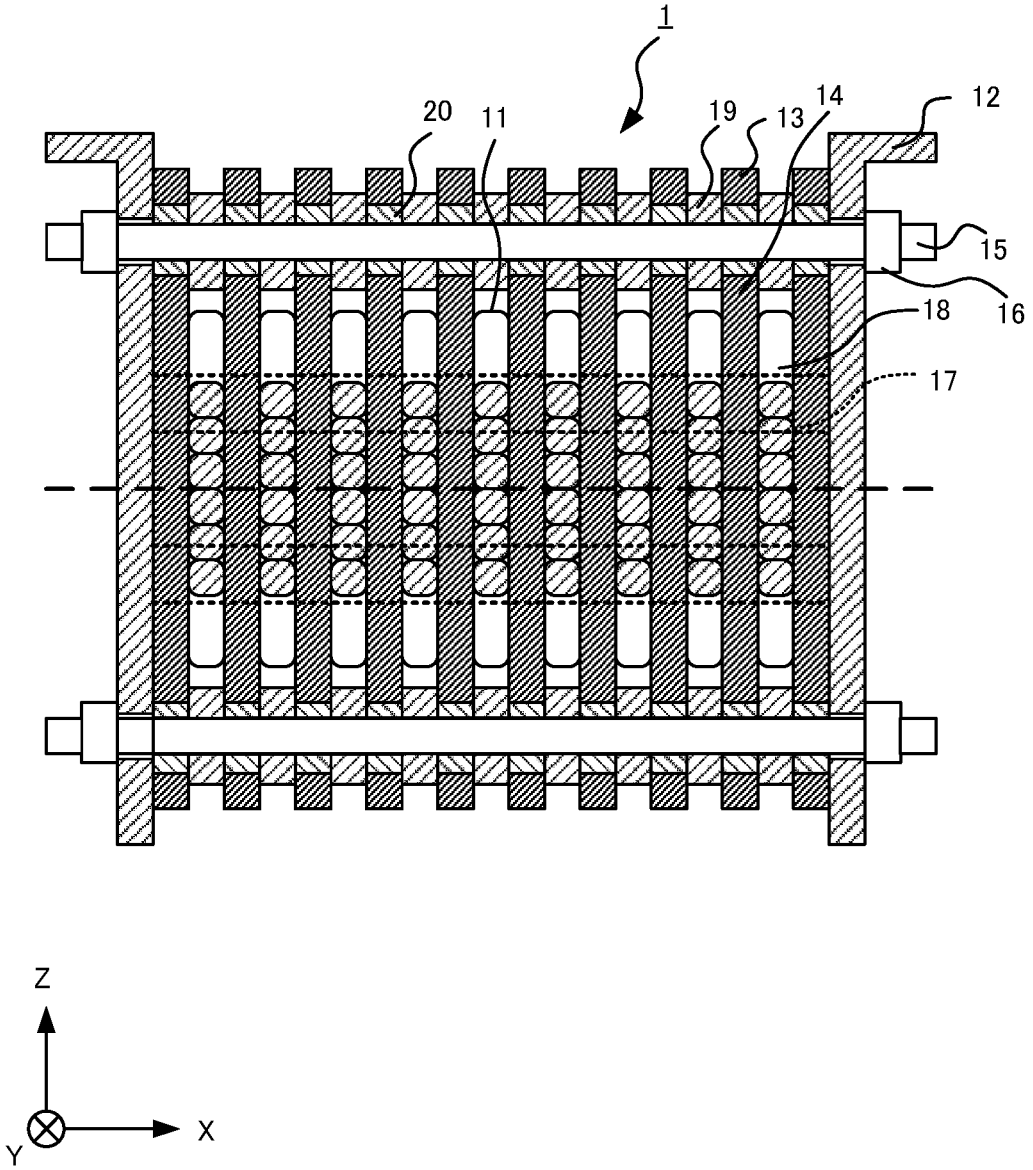
FIG. 7 is a cross-sectional view of a reactor according to Embodiment 2 of the present disclosure.

FIG. 7 is a cross-sectional view of a reactor according to Embodiment 2 of the present disclosure. The reactor 1 according to Embodiment 2 is equipped with third spacers 20 in addition to the configuration of the reactor according to Embodiment 1 illustrated in FIG. 2. The third spacers 20 are each disposed within the through hole formed in each of the first spacers 13. Each third spacer 20 abuts the adjacent second spacers 19 that sandwiches the first spacer 13 having the through hole in which the third spacer 20 is disposed. Each of the bolts 15 traverses the pair of supporting frames 12, the first spacers 13, the second spacers 19, and the third spacers 20. The fastening members 16 are fastened to each of the bolts 15, and the pair of supporting frames 12, the first spacers 13, the second spacers 19, and the third spacers 20 are thereby fixed relative to the bolts 15.

An X-axis direction thickness of the third spacer 20 is greater than or equal to an X-axis direction thickness of the first spacer 13 having the through hole in which the third spacer 20 is arranged. Thus the compressive force due to fastening of the bolts 15 is not applied to the coil 11 or the first spacers 13. In Embodiment 2, the third spacer 20 is ring shaped in the cross-section perpendicular to the X-axis direction. The third spacer 20 has an outer diameter smaller than the diameter of the through hole formed in the first spacer 13 and traversed by the bolt 15. In the same manner as the first spacer 13, the shape of the third spacer 20 may be freely selected. The third spacer 20 may be formed from the same material as that of the bolt 15 and the fastening member 16. For example, the third spacer 20 may be formed from a metal such as iron, stainless steel, or the like.

The reactor 1 according to Embodiment 2 is assembled in a manner similar to that of Embodiment 1. However, before arrangement of the first spacer 13, the bolts 15 are passed through the through holes of the third spacer 20 and then the third spacer 20 is arranged.

As described above, in the reactor 1 according to Embodiment 2, the first spacers 13 are disposed between the adjacent unit coils 18; the second spacers 19 having a thickness greater than the thickness of the unit coil 18 that is of when the coil 11 is not energized are disposed between the first spacers 13; the third spacers 20 are disposed in the through holes formed in the first spacers 13 and traversed by the bolts 15; the supporting frames 12, the first spacers 13, the second spacers 19, and the third spacers 20 are fixed to the bolts 15 traversing the supporting frames 12, the first spacers 13, the second spacers 19, and the third spacers 20; and the supporting members 17 are disposed abutting the outer peripheral face or inner peripheral face of the coil 11 so as to support the coil 11 in the vertical direction; and thus the compressive force applied to the coil can be decreased.

The embodiments of the present disclosure are not limited to the aforementioned embodiments. The aforementioned embodiments may be freely combined. For example, in the reactor 1 according to Embodiment 2, the second spacers 19 arranged between projection parts 14 located on the vertically lower-side may support the coil 11 in the vertical direction, instead of the supporting member 17 being provided. In the reactor 1 according to Embodiment 2, the X-axis direction thickness of the first spacers 13 may be varied in accordance with the distances from each of the supporting frames 12 to the first spacers 13. Furthermore, an opening may be arranged in the supporting frame 12 so that outside air may be allowed to flow into the interior of the coil 11. The cooling efficiency of the reactor 1 can be improved by such configuration.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1, 3 Reactor
11, 31 Coil
12, 32 Supporting frame
13, 33 First spacer
14 Projection part
15, 34 Bolt
16, 35 Fastening member
17 Supporting member
18, 36 Unit coil
19 Second spacer
20 Third spacer

The invention claimed is:

1. An air core reactor for rolling stock, comprising:

a coil having unit coils wound around a central axis that is horizontal, the unit coils being adjacent to each other with a space therebetween in a central axis direction that is a direction of the central axis;

a pair of supporting frames sandwiching the coil therebetween and having main faces opposing each other in the central axis direction;

first spacers disposed in (i) at least one of spaces between the unit coils adjacent to each other in the central axis direction and (ii) a space between each of the supporting frames and the coil, the first spacers being insulative and having projection parts that project outwardly from an outer peripheral face of the coil around the central axis;

second spacers each disposed between the projection parts of the first spacers adjacent to each other in the central axis direction;

bolts each traversing the pair of supporting frames, the first spacers, and the second spacers; and fastening members fastened at both ends of each of the bolts to sandwich the pair of supporting frames so that the pair of supporting frames, the first spacers, and the second spacers are fixed relative to the bolts, wherein a spacing distance between the adjacent first spacers is greater than a central-axis-direction thickness of the unit coil located between the adjacent first spacers, the central-axis-direction thickness of the unit coil being of when the coil is not energized.

2. The air core reactor according to claim 1, wherein each of the second spacers abuts the adjacent first spacers that sandwich each of the second spacers, and a central-axis-direction thickness of the second spacer is greater than the central-axis-direction thickness of the unit coil located between the adjacent first spacers sandwiching the second spacer, the central-axis-direction thickness of the unit coil being of when the coil is energized.

3. The air core reactor according to claim 1, further comprising:

third spacers each disposed within the through hole formed in each of the first spacers, wherein each of the third spacers abuts the adjacent second spacers sandwiching the first spacer having the through hole in which the third spacer is disposed, each of the bolts traverses the pair of supporting frames, the first spacers, the second spacers, and the third spacers, the fastening members are fastened at both ends of each of the bolts to sandwich the pair of supporting frames so that the pair of supporting frames, the first spacers, the second spacers, and the third spacers are fixed relative to the bolts, and a central-axis-direction thickness of the third spacer is greater than or equal to a central-axis-direction thickness of the first spacer having the through hole in which the third spacer is disposed.

4. The air core reactor according to claim 2, further comprising:

third spacers each disposed within the through hole formed in each of the first spacers, wherein each of the third spacers abuts the adjacent second spacers sandwiching the first spacer having the through hole in which the third spacer is disposed, each of the bolts traverses the pair of supporting frames, the first spacers, the second spacers, and the third spacers, the fastening members are fastened at both ends of each of the bolts to sandwich the pair of supporting frames so that the pair of supporting frames, the first spacers, the second spacers, and the third spacers are fixed relative to the bolts, and a central-axis-direction thickness of the third spacer is greater than or equal to a central-axis-direction thickness of the first spacer having the through hole in which the third spacer is disposed.

5. The air core reactor according to claim 1, wherein
the first spacers are a plurality of pairs of first spacers extending in the vertical direction, each pair of first spacers opposing each other in a horizontal direction on opposite sides of the central axis, and
both ends of each of the first spacers in the vertical direction form the projection parts.

6. The air core reactor according to claim 2, wherein
the first spacers are a plurality of pairs of first spacers extending in the vertical direction, each pair of first spacers opposing each other in a horizontal direction on opposite sides of the central axis, and
both ends of each of the first spacers in the vertical direction form the projection parts.

7. The air core reactor according to claim 3, wherein
the first spacers are a plurality of pairs of first spacers extending in the vertical direction, each pair of first spacers opposing each other in a horizontal direction on opposite sides of the central axis, and
both ends of each of the first spacers in the vertical direction form the projection parts.

8. The air core reactor according to claim 1, wherein
a space is defined between an outer peripheral face of each of the bolts and a wall surface of a through hole formed in each of the first spacers and traversed by each of the bolts.

9. The air core reactor according to claim 2, wherein
a space is defined between an outer peripheral face of each of the bolts and a wall surface of a through hole formed in each of the first spacers and traversed by each of the bolts.

10. The air core reactor according to claim 3, wherein
a space is defined between an outer peripheral face of each of the bolts and a wall surface of a through hole formed in each of the first spacers and traversed by each of the bolts.

11. The air core reactor according to claim 1, further comprising:
a supporting member abutting the outer peripheral face of the coil or an inner peripheral face of the coil around the central axis to suppress movement of the coil in the central axis direction, and supporting the coil in a vertical direction, the supporting member being insulative.

12. The air core reactor according to claim 2, further comprising:
a supporting member abutting the outer peripheral face of the coil or an inner peripheral face of the coil around the central axis to suppress movement of the coil in the central axis direction, and supporting the coil in a vertical direction, the supporting member being insulative.

13. The air core reactor according to claim 11, wherein the second spacers disposed between the projection parts that are formed by vertically lower-side ends of the first spacers serve as the supporting member, and the second spacers are formed as insulating members, and abut the outer peripheral face of the coil and are fixed to the coil to support the coil in the vertical direction.

14. The air core reactor according to claim 12, wherein the second spacers disposed between the projection parts that are formed by vertically lower-side ends of the first spacers serve as the supporting member, and the second spacers are formed as insulating members, and abut the outer peripheral face of the coil and are fixed to the coil to support the coil in the vertical direction.

15. The air core reactor according to claim 11, wherein the supporting member is fixed at both ends thereof to the pair of supporting frames and abuts the inner peripheral face of the coil and is fixed to the coil to support the coil in the vertical direction.

16. The air core reactor according to claim 12, wherein the supporting member is fixed at both ends thereof to the pair of supporting frames and abuts the inner peripheral face of the coil and is fixed to the coil to support the coil in the vertical direction.

17. The air core reactor according to claim 1, wherein the central-axis-direction thickness of the first spacer disposed between the adjacent unit coils is determined in accordance with distances of the first spacer from the pair of supporting frames.

18. The air core reactor according to claim 2, wherein the central-axis-direction thickness of the first spacer disposed between the adjacent unit coils is determined in accordance with distances of the first spacer from the pair of supporting frames.

19. The air core reactor according to claim 17, wherein the first spacers disposed between the adjacent unit coils and located at positions where differences in distances of the first spacers from the pair of supporting frames are smaller have greater central-axis-direction thicknesses.

20. The air core reactor according to claim 18, wherein the first spacers disposed between the adjacent unit coils and located at positions where differences in distances of the first spacers from the pair of supporting frames are smaller have greater central-axis-direction thicknesses.

* * * * *